US005833584A

United States Patent [19]

Piaget et al.

[11] Patent Number: 5,833,584

[45] Date of Patent: Nov. 10, 1998

[54] STRIDING EXERCISER WITH UPWARDLY CURVED TRACKS

[75] Inventors: Gary D. Piaget; Trace O. Gordon, both of Park City, Utah; Adolf H. Friedebach, Waconia; Paul M. Theisen, Shakopee, both of Minn.

[73] Assignee: Fitness Master, Inc., Waconia, Mich.

[21] Appl. No.: 490,904

[22] Filed: Jun. 16, 1995

Related U.S. Application Data

[63] Continuation-in-part of Ser. No. 449,658, May 24, 1995, Pat. No. 5,575,740, which is a continuation of Ser. No. 129,592, Sep. 30, 1993, abandoned.

[51] Int. Cl.[6] ..... A63B 22/00

[52] U.S. Cl. ..... 482/70; 482/51

[58] Field of Search ..... 482/51, 70, 71; D21/193, 192, 191

[56] References Cited

U.S. PATENT DOCUMENTS

| | | | |
|---|---|---|---|
| 219,439 | 9/1879 | Blend | 482/51 |
| 2,842,365 | 7/1958 | Kelley | 482/51 |
| 4,176,836 | 12/1979 | Coyle | 482/92 |
| 5,181,894 | 1/1993 | Shieng | 482/70 |

FOREIGN PATENT DOCUMENTS

| | | | |
|---|---|---|---|
| 0579401 | 9/1976 | Switzerland | 482/71 |

*Primary Examiner*—Stephen R. Crow
*Attorney, Agent, or Firm*—Salter & Michaelson

[57] ABSTRACT

A striding exercise device with a base having at least one elongated track defining a continuous arc that curves upward along at least one end portion thereof. At least a portion of the continuous arc has a curvature generally corresponding to the swing arc of the operator's leg. Two footskates are slidably engaged with the at least one track. The footskates are operable for receiving feet of an operator. The operator reciprocates the feet back and forth so that the footskates move in reciprocating motion along at least a portion of the continuous arc. The continuous arc may have a constant or variable radius, adjustable by the operator. Pivotable hand levers or sliding hand grips provide upper body resistance for the operator. The pivotable hand levers may be locked in a plurality of position within the range of motion of the operator so as to operate as handlebars. A motor may assist the operator in reciprocating the footskates. The electronic display unit may be activated by movement of the footskates or by controls on the hand levers.

3 Claims, 14 Drawing Sheets

STRIDING EXERCISER WITH UPWARDLY CURVED TRACKS

CROSS-REFERENCE TO RELATED APPLICATIONS

This application is a continuation-in-part of application Ser. No. 08/449,658, filed on May 24, 1995, now U.S. Pat. No. 5,575,740 which is a continuation of Ser. No. 08/129,592, filed Sep. 30, 1993, now abandoned.

FIELD OF THE INVENTION

The instant invention relates to an exercise apparatus, and more particularly, to a striding exerciser with reciprocating footskates with upper body resistance and method for using same.

BACKGROUND OF THE INVENTION

Walking, jogging, and cross-country skiing have been found to be effective activities for exercising the body, and in particular, the legs, heart and lungs. However, these activities are primarily outdoor activities which can be severely limited by adverse weather and geographic conditions. The limitations of traditional outdoor exercise activities have in some respects been resolved by the development of indoor exercise devices which simulate particular exercise activities. In this regard, a wide variety of walking, striding and cross-country skiing devices have heretofore been known in the art.

One such device is a cross-country skiing machine having a pair of parallel horizontal rails and a pair of footplates which are movably supported on the rails. The cross-country skiing device further includes a belt mechanism which causes the footplates to move in unison in opposite directions. Still further, the skiing device includes two independent hand levers which pivot back and forth to simulate the movement of cross-country ski poles. In use, the operator stands upon the footplates and reciprocates the footplates back and forth while simultaneously pushing and pulling the hand levers. While such cross-country skiing devices are capable of providing a significant aerobic workout, it has been found that it also places stress on the back and leg joints that is problematic for some operators. The reciprocating movement of the feet along a horizontal path causes the operator's torso to move up and down, thereby forcing the operator to continuously lift his/her body weight with each stride.

In addition, the up and down lifting motion of the torso increases the stress placed on the leg joints, particularly the hip and knee joints. Still further, the pushing and pulling of the hand levers forces the operator to bend over and reach from the waist which unnecessarily stresses the back muscles. Accordingly, it has been found that persons who have back, knee or hip problems often find it uncomfortable, painful, or even impossible to utilize ski-type exercise machines.

Another striding-type exerciser has a pair of spaced vertical frame members and a pair of swinging leg members which are pivotally mounted on the vertical frame members. In use, the operator stands on platforms which are mounted at the ends of the swinging leg members and reciprocates his/her legs back and forth in a swinging motion between the vertical frame members. The swinging movement of the legs in a striding-type exerciser provides substantially the same aerobic benefits as cross-country ski exerciser.

When a striding-type exerciser includes hand levers, the levers usually rotate about a point which do not require the operator to bend or reach while exercising. Although striding exercisers have been found to be highly effective in providing a low stress aerobic workout, they have several design problems which prevents their widespread marketability and use. Striding exercise devices generally require heavy duty frame members and heavy duty bearings to accommodate the weight of the operator on the pivot mechanisms. As a result, these machines are too bulky and too heavy for use within the home. In addition, the required heavy duty construction makes striding exercisers too costly to compete with other less expensive exercise devices. Accordingly, striding exercisers are usually only found in institutional rehabilitation centers and large scale exercise facilities that have substantial funds for purchasing and maintaining these machines.

SUMMARY OF THE INVENTION

The present invention is directed to a striding exercise device with a base having at least one elongated track defining a continuous arc that curves upward along at least one end portion thereof. The end portion may be one or both ends of the striding exerciser. At least a portion of the continuous arc has a curvature generally corresponding to the swing arc of the operator's leg. Two footskates are movably engaged with the at least one track. The footskates are operable for receiving feet of an operator. The operator reciprocates the feet back and forth so that the footskates move in reciprocating motion along at least a portion of the continuous arc.

In another embodiment, a vertically adjustable or telescoping support is provided for supportively raising and lowering at least one end portion of the elongated track to simulate a striding exerciser with a generally horizonal end portion.

The continuous arc may have a constant or variable radius. A mechanism may be provided for modifying the radius of curvature of the continuous arc. In one embodiment, the elongated track is releasably retained to the base. Front and rear moveable track supports are provided for independently modifying the radius of curvature of the front and rear of the elongated track. Alternatively, the end portions of the releasably track are fixed and the middle portion is raised or lowered to achieve the desired radius of curvature.

Another embodiment of the striding exerciser includes pivotable hand levers for providing upper body resistance for the operator. The base may have a plurality of attachment points for receiving pivotable hand levers. The pivotable hand levers are connected to the base by a variable resistance system. The pivotable hand levers may have a contour generally following a contour of the continuous arc, and may be telescoping to facilitate shipping and storage.

The pivotable hand levers may be locked in a plurality of positions by a spring loaded locking pin or other suitable locking mechanisms. The hand levers may be locked in a forward position out of reach by the operator or adjacent to the base for shipping and storage. Alternatively, the pivotable hand levers may be locked into a plurality of positions proximate the operator to be used as handlebars. In another embodiment, a bridge structure may be attached to the locked hand levers to add stability to the structure. The bridge includes a handle for gripping by the operator and a tray for holding various items. It will be understood that the present locking mechanism and bridge structure may be used with a variety of exercise devices having a base for supporting an operator's feet during exercise and pivotable hand levers for providing upper body resistance for the operator.

The pivotable handle levers may include an operator activated communication mechanism for controlling an electronic display and/or an electronic resistance control unit. The communication mechanism may be infrared or ultrasonic. The operator activated communications mechanism may also be used to control a motor powering the footskates. Alternatively, switch may be provided for automatically activating the electronic display unit when an operator moves the footskates.

In another embodiment, two footskates are connected to a variable resistance mechanism for providing variable resistance to the footskates. Alternatively, the footskates may be connected to a motor for moving the footskates in an opposite reciprocating motion along the elongated tracks. The handlebars may have an operator control device for controlling the operation of the motor.

The present invention is also directed to a method for operating a striding exerciser with upper body resistance. The operator locates both feet on footskates slidably engaged with at least one elongated track and grips the moveable handle grips. The operator then reciprocates the footskates along at least a portion of the at least one track while simultaneously reciprocating the moveable handle grips.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
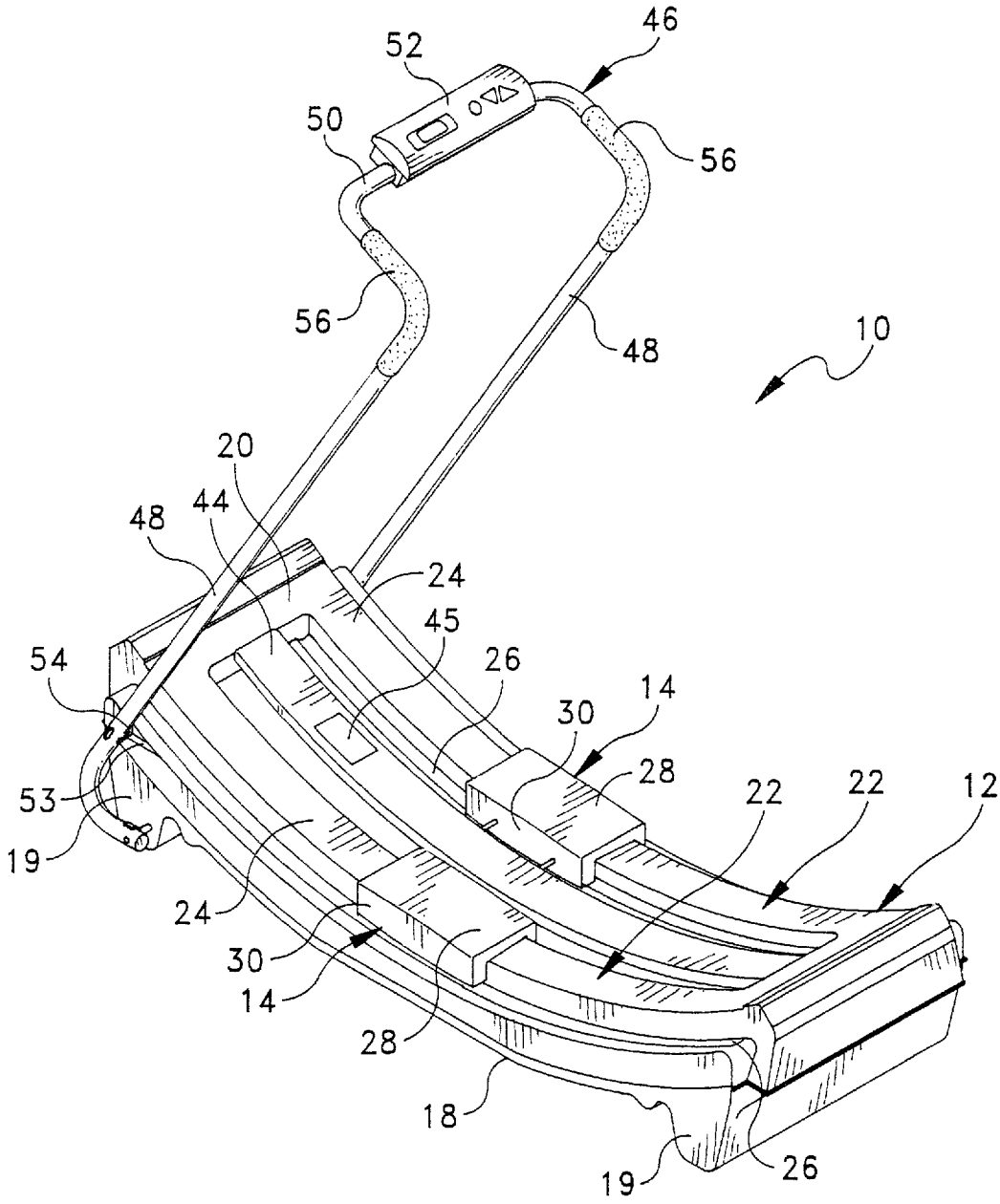
FIG. 1 is a perspective view of a striding exerciser with an upwardly curved track.

As will be discussed in detail below, the reciprocating footskates on the upwardly curved tracks of the present invention provide a number of advantages over the prior art. First, caloric expenditures using the present striding exerciser are approximately twice as great as the caloric expenditures for walking on a level, firm surface at a comparable pace. Second, the impact force as a percentage of body weight generated while using the present striding exerciser is significantly less than the impact force generated while using alternate exercise equipment, such as shuffle-type skiers, stair machines, motorized and manual treadmills, as well as over ground walking. The cardiovascular exercise provided by the present striding exerciser generates virtually no impact to the operator, and as such has proven to be a significant benefit to the elderly, disabled, and individuals in postoperative rehabilitation. Third, the present striding exerciser allows and encourages operators to increase their stride length to a greater degree than ski machines or walking on a flat surface or on a treadmill. Additionally, the long stride length promoted by the present striding exerciser invention is generally not dependent on the height of the operator. This result is contrary to stride length analysis for ski machines and treadmills.

A study of 20 subjects was conducted to compare the caloric expenditure as calculated from metabolic data for the present striding exerciser at various speeds and in three different modes of exercising. The three modes of exercising included holding the front rail, using full pendulum arm swings, and wearing wrist weights. For a comparable level of activity, the present striding exerciser burned up to 700 kcal/hr while holding the front rail or swinging the arms, and up to 800 kcal/hr when swinging 1.5 lb. wrist weights through a full range of motion. It is estimated that the caloric expenditure for walking on a variety of terrains burns an average of approximately 350 kcal/hr.

An electromyographic analysis comparing muscle activity while using the striding exerciser and walking on a manual treadmill indicates that the striding exerciser requires greater activation of muscle fibers and consequently greater energy demand through a greater range of motion than is otherwise required during walking. Additionally, the movement of the footskates along the upwardly curved tracks requires use of larger muscles of the hips, thighs, and buttocks as the primary source of power, rather than the smaller muscles in the lower legs and ankles which are typically utilized during walking. The present striding exerciser permits operators to burn approximately twice the calories as would be consumed during walking.

A study was also conducted to compare the impact force as a percentage of body weight of the present striding exerciser with stair machines, shuffle-type ski machines, nonmotorized treadmills, motorized treadmills, and overground walking. These prior art devices resulted in between 9 and 53% greater impact force as a percentage of body weight than use of the present striding exerciser. Additionally, the force developed while using the striding exerciser was relatively evenly distributed throughout the entire gait cycle, rather than having the spike of force exhibited by the prior art devices at various intervals across the gait cycle. The smooth movement of the footskates along the upwardly curved track of the striding exerciser results in no airborne, and thus no landing phase, so as to minimize impact on the lower extremities.

Finally, a study was conducted to compare the average stride length of the present striding exerciser to use of a motorized treadmill and a ski machine. The average stride length of a subject when exercising on the striding exerciser was 9.6 and 7.4 inches longer (27% and 38% greater, respectively) than when exercising on a ski machine or walking on a treadmill, respectively. Perhaps of greater importance is that the increase in stride length for the subjects using the striding exerciser was not closely correlated with the height of the subjects. On the other hand, the stride length of the subjects on the treadmill and the ski machine increased only with the height of the subject. Consequently, the upwardly curved tracks on the striding exerciser permits and encourages most operators to move through a greater range of motion than achieved on a treadmill or ski machine. Exercising through a greater range of motion is well documented as providing significant advantages in terms of strength gain, flexibility, and resistance to injury.

Referring now to the drawings, several embodiment of a striding exerciser 10 are illustrated FIGS. 1–5. The striding exerciser 10 has a curved base 12, two footskates 14 which are movably supported on the base 12, and an optional pulley mechanism 16 (see FIG. 2) which is operative for moving the footskates 14 in opposite reciprocating motion. The base 12 has a contoured lower side 18, spaced legs 19 for supporting the base 12 on a flat supporting surface, and a contoured upper side 20. The contoured upper side 20 includes two elongated parallel tracks 22 which curve upwardly in a continuous arc. The upward curvature of the tracks 22 generally corresponds to the natural swinging arc of a human leg as it pivots about its hip joint.

The tracks 22 may define a constant radius arc or a plurality of radii. Each of the tracks 22 includes a center ridge 24 and two spaced grooves 26 on either side of the ridge 24 which are adapted for supporting the footskates 14. (see FIG. 5). The contoured upper side 20 further includes an elongated central ridge 27 which longitudinally extends between the two tracks 22.

The base 12 may be constructed from various materials including, polymeric materials such as polyethylene using a blow-molding process known in the art. Alternatively, rotational molding may be used to provide greater wall thickness to the base 12. It will be understood that the base 12 may be constructed in a variety ways and that the present invention is not limited by the particular method disclosed. For example, the base 12 may be constructed from tubular, extruded, roll formed or stamped metal components, wherein the upwardly curved tracks are formed from parallel rails.

The footskates 14 are generally U-shaped (see FIG. 5) and have a horizontal body portion 28 for receiving the operator's foot thereon, two downwardly extending leg portions 30, and four skate wheels 32 which are rotatably mounted to the leg portions 30. The body portion 28 of the footskate 14 is received over the center ridge 24 of the respective track 22 so that the wheels 32 ride in the spaced grooves 26 on both sides of the ridge 24. It can thus be seen that the footskates 14 are movable back and forth along the length of the tracks 22. It will be understood that a variety of mechanisms may be substituted for the skate wheels 32, such as linear or curvilinear bearings, low-friction pads, etc.

Figure 5:
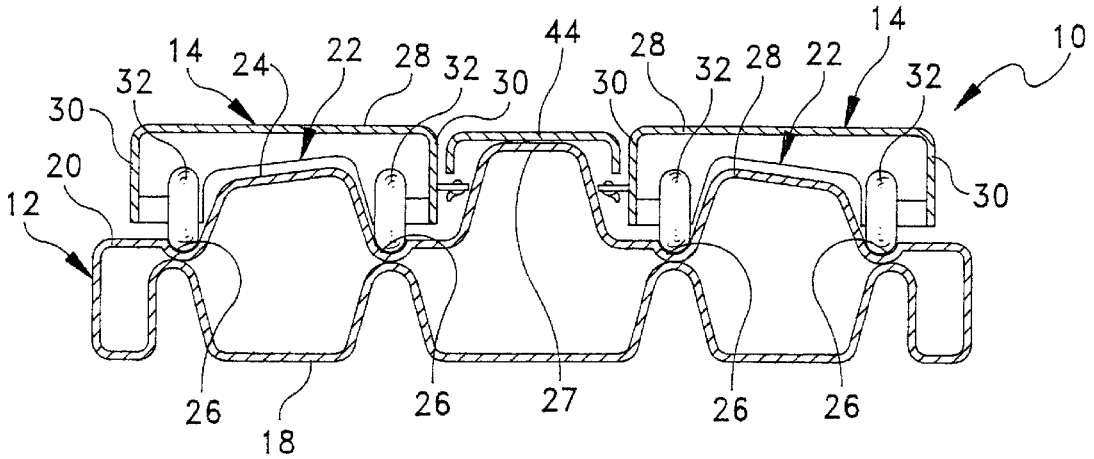
FIG. 5 is a sectional view of footskates for a striding exerciser.
Figure 5A:
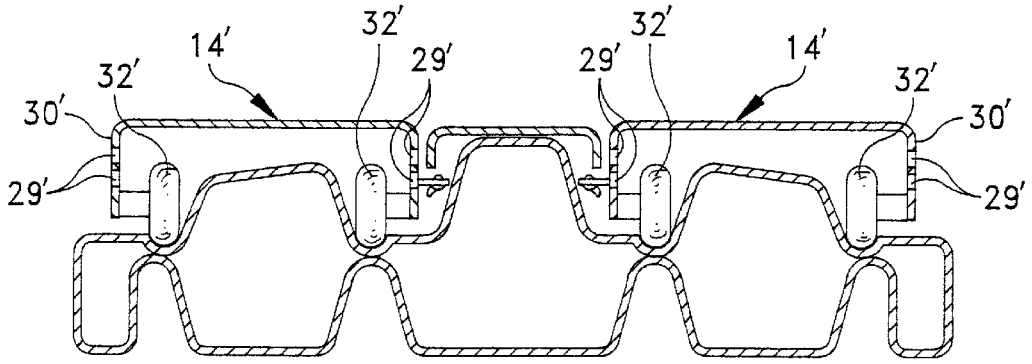
FIG. 5A is a sectional view of an alternate footskates having an attitude adjustment mechanism.

In an alternate embodiment illustrated in FIG. 5A, a plurality of holes 29' are provided in the footskates 14' so that wheels 32' may be located in a variety of positions on downwardly extending leg portions 30'. In particular, the surface angle of the foot skates 14' can be adjusted to compensate for variations in stride of the operator. In the embodiment disclosed in FIG. 5A, the four wheels 32' may be adjusted independently so that the surface of the footskate 14' may be level, inclined or declined forward and back, angled to either side, or any combination thereof. It will be understood that the surface of the footskates 14' may be adjusted by a variety of other mechanisms without departing from the scope of the present invention. For example, a ratcheting device or an eccentric cam may be used to achieve the adjustment of the footskates 14'.

Figure 2:
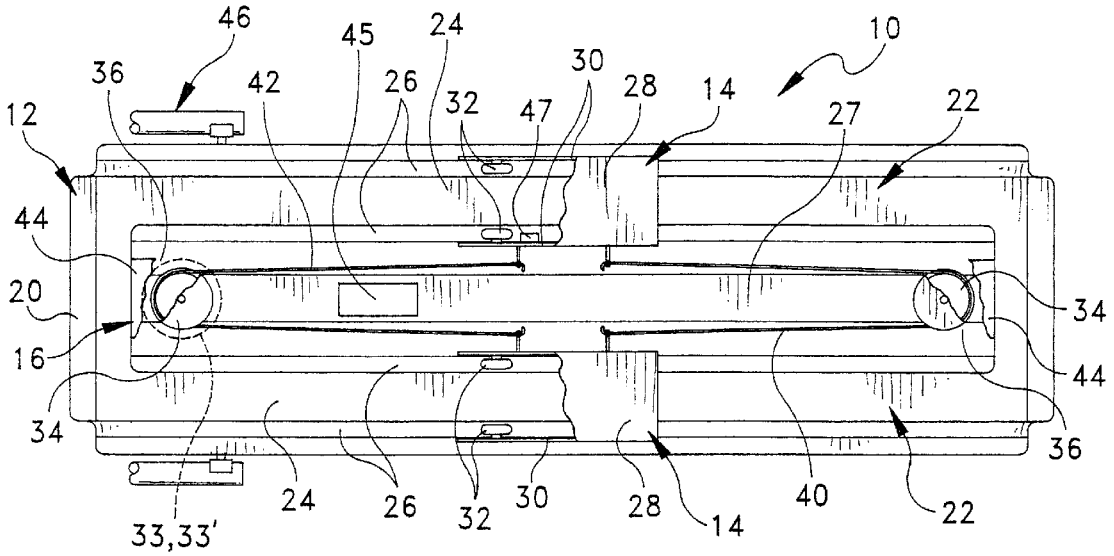
FIG. 2 is a top view of a striding exerciser.
Figure 3:
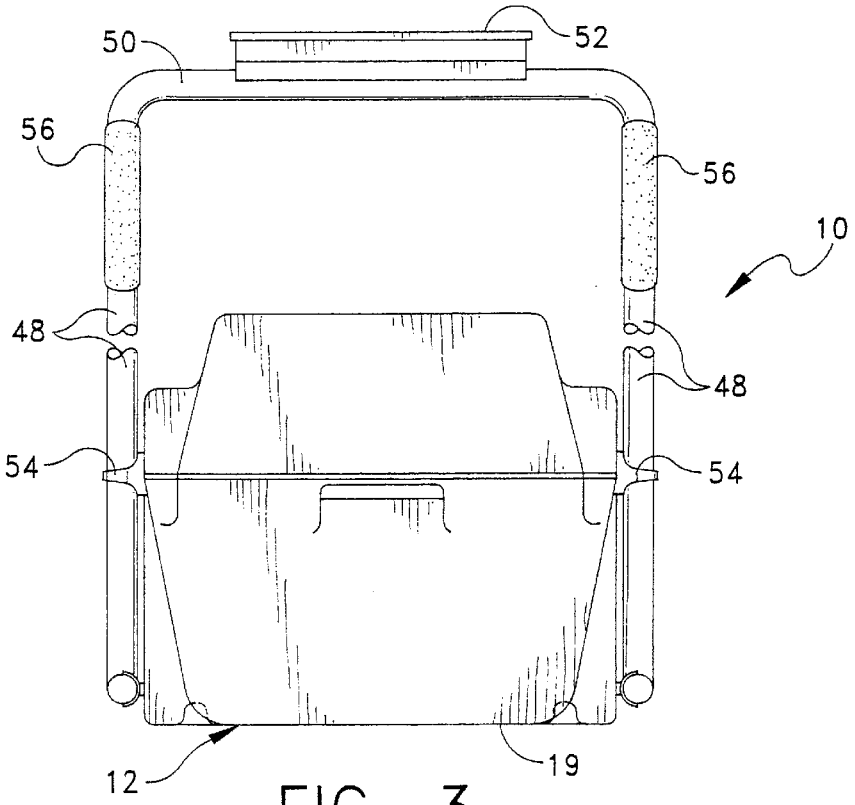
FIG. 3 is a front view of a striding exerciser.

Turning now to FIG. 2, the pulley mechanism 16 is attached to both footskates 14 for operatively for causing the footskates 14 to reciprocate in opposite directions along the track 22 during use. The pulley mechanism 16 comprises two pulleys 34 which are respectively mounted in depressions 36 formed at the front and rear ends of the central ridge 25. A cord 38 is attached to each of the footskates 14 and extends around the pulleys 34 to form a continuous loop. More specifically, there is a first cord section 40 which is attached to the rear end of one of the footskates 14 and extends around the rear pulley 34 and is attached to the rear end of the other footskate 14. Likewise, there is a second cord section 42 which is attached to the front end of the first footskate 14 and extends around the front pulley 34 and is attached to the front end of the other footskate 14. It can therefore be seen that when one of the footskates 14 is moved forward in its track, the other footskate 14 is moved rearwardly in its track.

The base 12 is provided with a cover 44 which is releasably mounted over the central ridge 26 to conceal the pulleys 34 and cord sections 40 and 42 from sight and to prevent the operator's feet from becoming entangled with the cord sections 40 and 42 during use. The cover 44 also retains the cord sections 40 and 42 so that they conform to the curved shape of the base 12. Various electronics 45 for monitoring and controlling the striding exerciser 10 may be mounted either above or below the cover 44, or at a variety of other locations.

In one embodiment, the electronics 45 are activated when the operator moves a magnetic switch 47 located on a footskate 14 past the electronics 45. The electronics 45 in turn activate electronic display unit 52. The display unit 52 displays time, speed, distance, calories, and other variable for the operator. The magnetic switch 47 may also be used to monitor the movement of the footskates 14 during exercise in real-time so that speed, distance, calories burn, etc. may be measured. The electronics 45 may be coupled to the display unit 52 either by a direct wire connection or via an RF communication signal, such as infrared. When the operator stops movement of the footskates 14, the electronics 45 will automatically enter a sleep mode. The electronics 45 may be configured to save the prior workout indefinitely or for some predetermined time.

In an alternate embodiment, one of the pulleys 34 may be mounted on the shaft of a motor 33. A variable speed DC motor operated by an electronic motor control 45 moves the footskates 14 in a reciprocating motion along the elongated parallel tracks 22. Reversal of direction of the footskates 14 is achieved by the electronic motor control 45 or by means of a mechanical linkage having a crankshaft with a connecting rod such that the throw of the crankshaft can be varied to permit different stride lengths. The electronic motor control 45 may also control the range of motion of the footskates 14, thereby controlling the stride length of the operator. In this embodiment, the motor 33 provides at least a portion of the power for the operator's leg movement, although it may be configured to provide all of the power necessary to move the operator's legs. This embodiment is particularly useful for patients in rehabilitation or those having arthritis. In an alternate embodiment, the footskates 14 may be powered by a pneumatic or hydraulic drive unit.

Alternatively, a variable resistance mechanism 33' may be substituted for the motor 33 to provide variable resistance to the footskates 14. Exemplary variable resistance mechanisms 33' are disclosed in U.S. Pat. No. 4,529,194 issued to Haaheim on Jul. 16, 1985 and U.S. Pat. No. 5,145,481 issued to Friedebach on Sep. 8, 1992, both of which are hereby incorporated by reference. It will be understood that a variety of resistance mechanisms may be suitable for the present striding exerciser 10. For example, a resistance mechanism such as a friction pad engaged with the center ridge 24 may be incorporated into each of the footskates 14. Providing a resistance mechanism on each footskate 14 permits the operator to independently adjust the level of resistance for each footskate 14.

In yet another embodiment, the first and second cords 40, 42 are disengaged and the footskates 14 are permitted to move independently. In this configuration, the striding exerciser 10 would demand greater coordination and balance than required when the footskates 14 are interconnected. It is contemplated that this embodiment would be most useful for operators in good physical condition who desires the additional challenge of independent leg movement. Alternatively, this embodiment may be useful for patients with special rehabilitative needs.

The striding exerciser 10 further includes a set of handlebars generally indicated at 46 which are connected to the front end of the base 12. The handlebars 46 include two downwardly extending arm portions 48 which are pivotally connected to the sides of the base 12 and a horizontal body portion 50 which is operative for supporting an electronic display unit 52. The pivotal connection of the arm portions 48 enables the handlebars 46 to be pivoted downwardly out of the way so that the entire exercise device 10 may be more easily transported and stored. In order to maintain the handlebars 46 in a stable and upright position, the sides of the base 12 include two triangular depressions 53 which are operative for frictionally receiving circular support members 54 mounted to the arm portions 48. The arm portions 48 of the handlebars 46 further include rubber or foam pad hand grips 56 for the operator to grasp during use.

Figure 4:
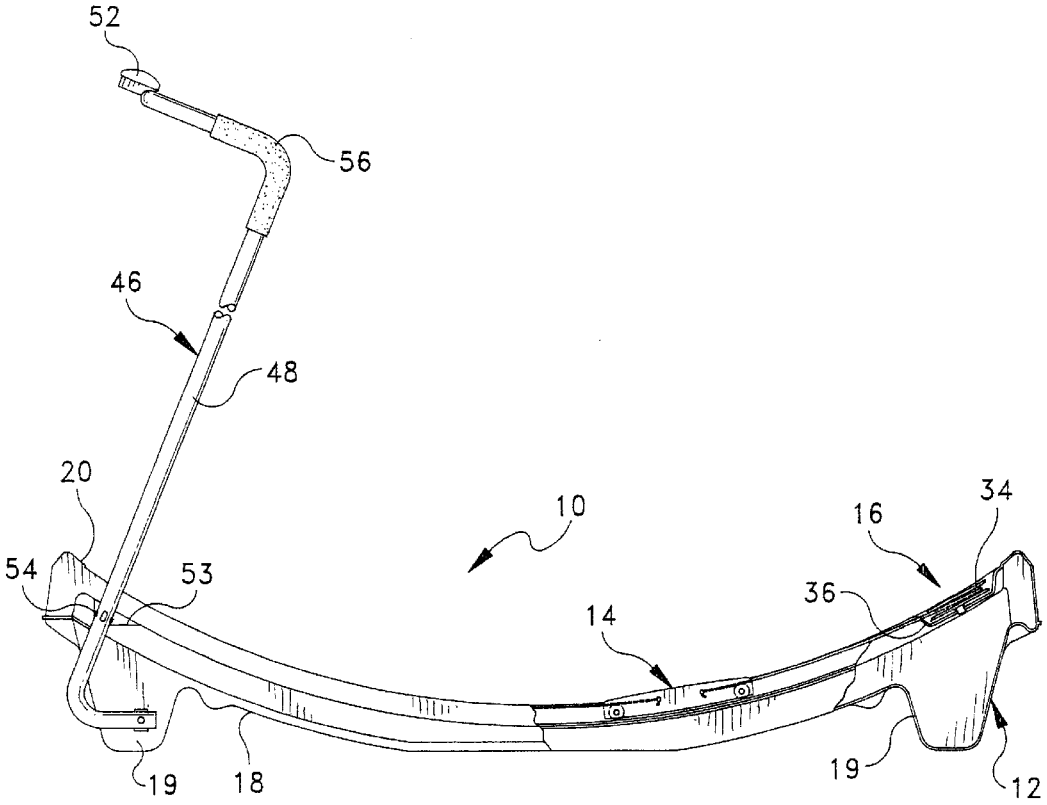
FIG. 4 is a cross-sectional view of an exemplary pulley system for interconnecting the footskates on a striding exerciser.
Figure 4A:
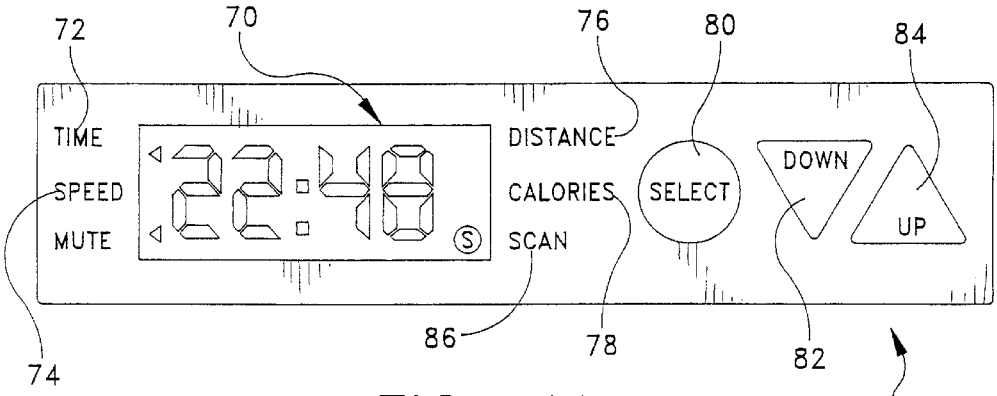
FIG. 4A is an exemplary electronic display unit of the present striding exerciser.

The electronic display unit 52 illustrated in FIG. 4A has an LCD 70 for providing the operator with an indication of time 72, speed (in miles per hour) 74, distance (in miles) 76, and calories burned 78. The values for speed, distance, and calories are based on the pace set by a cadence beeper or by the actual movement of the footskates 14 as measured by the electronics 45 and magnetic switch 47. The electronic display unit 52 is activated by pressing any of the buttons 80, 82, 84. A preset exercise time may be programmed by pressing the select button 80 until the arrow next to time 72 is activated and pressing the up or down arrows 82, 84 until the desired time appears in the LCD 70. Alternatively, the LCD 70 may count up from zero.

Speed 74 may be set by pressing the select button 80 until an arrow next to the speed indicator 74 is activated, and pressing the up or down arrows 82, 84 until the desired speed is displayed by the LCD 70. The electronic display unit 52 provides a cadence beep corresponding to the selected speed. The operator's feet must move through a complete cycle for each cadence beep in order to achieve the displayed speed. Calories burned 78 is determined in part by the speed set by the operator.

Scan mode 86 is automatically engaged after time and speed have been set by the operator. The scan mode automatically switches between time, speed, distance, and calories, sequentially at five-second intervals. The scan mode 86 may be programmed to display the critical exercise variable in-between each of the other variables. For example, if time is selected as the critical variable, the operator's time is displayed in-between speed, distance and calories, respectively. The exemplary scan sequence being: time-speed-time-distance-time-calories-time-speed-etc. Alternatively, the operator may select speed, distance or calories as the critical variable for display during the scan mode 86.

In use, the operator stands on the footskates 14, grasps the rubber pad hand-grips 56 on the handlebars 46, and reciprocates the footskates 14 back and forth along the upwardly curved tracks 22. While the handlebars 46 are provided to help maintain balance during use, it has been found that the instant striding exerciser 10 so well balances the operator over the base 12 that the use of the handlebars 46 is optional during operation. In this connection, operators may wish to swing their arms as would be normal when walking and, in addition, to utilize hand weights in order to increase the aerobic benefits.

The upward curvature of the tracks 22 generally corresponds with the natural swinging arc of the operator's leg, and maintains the operator's torso in a stationary and balanced position over the base 12. The curved tracks 22 allow the operator's legs to naturally pivot around their hip joint without requiring the legs to lift the body or torso upwardly with each stride. Because the legs are not required to continuously lift the operator's weight, there is minimal strain placed on the leg joints, especially the ankles, knees and hip joints. In addition, the stationary position of the torso substantially eliminates the back strain commonly associated with repetitive bending and reaching in conventional cross-country ski machines. The combined effect is to virtually eliminate physical stress on both the back and legs of the operator, while providing an effective aerobic workout.

Figure 6:
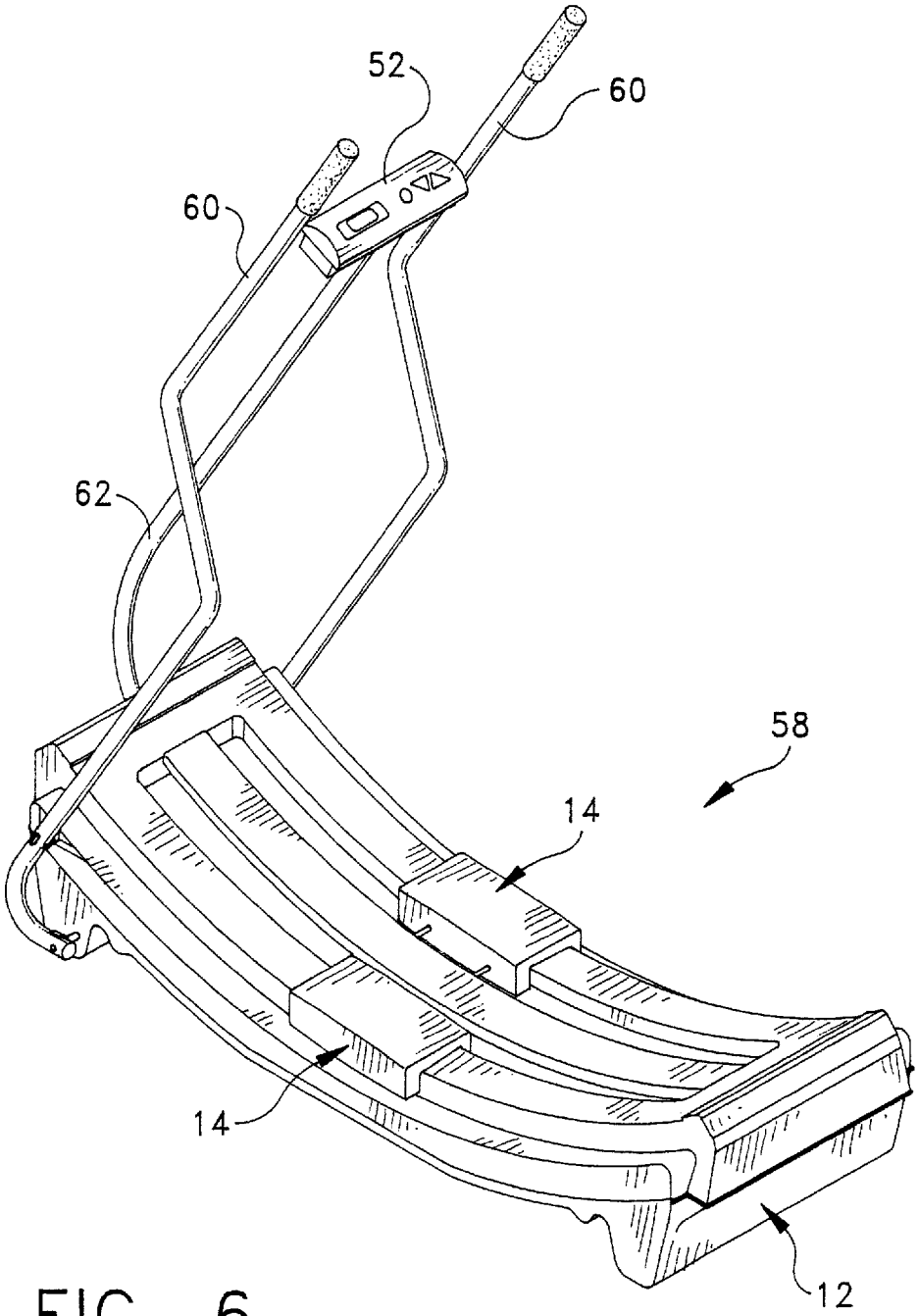
FIG. 6 is a perspective view of an alternate striding exerciser providing an upper body resistance mechanism.

An alternate embodiment of a striding exerciser 58 is illustrated in FIG. 6. The handlebars 46 are replaced by two pivotable hand levers 60. The hand levers 60 are mounted to the sides of the base 12 by means of rotatable couplings (not shown) which have conventional resistance means for adjusting the resistance level of movement of the hand levers 60. The hand levers 60 allow the operator to simultaneously exercise the upper body during use of the exerciser 58. The operator simply grasps the hand levers 60 and reciprocates them in opposite directions to the footskates 14. The electronic display unit 52 is supported by center column support 62 attached at the front of the base 12.

A resistance system known to be suitable for use with the present invention is disclosed in U.S. Pat. No. 5,145,481 issued to Friedebach on Sep. 8, 1992, which is hereby incorporated by reference. Alternatively, a hydraulic or pneumatic piston and rod connected to the hand levers 60 may provide resistance in one or both directions of travel. Each lever 60 may be provided with its own resistance cylinder or they may be interconnected to a single resistance cylinder. A suitable arrangement of control valves and check valve would allow resistance in one or both directions, selectable by the operator. In an alternate embodiment, an elastomeric material may be used to create the resistance force for the levers 60. In particular, shear, tension or compression forces, or some combination thereof, may be created by the levers 60 on a suitable elastomeric material.

Figure 7:
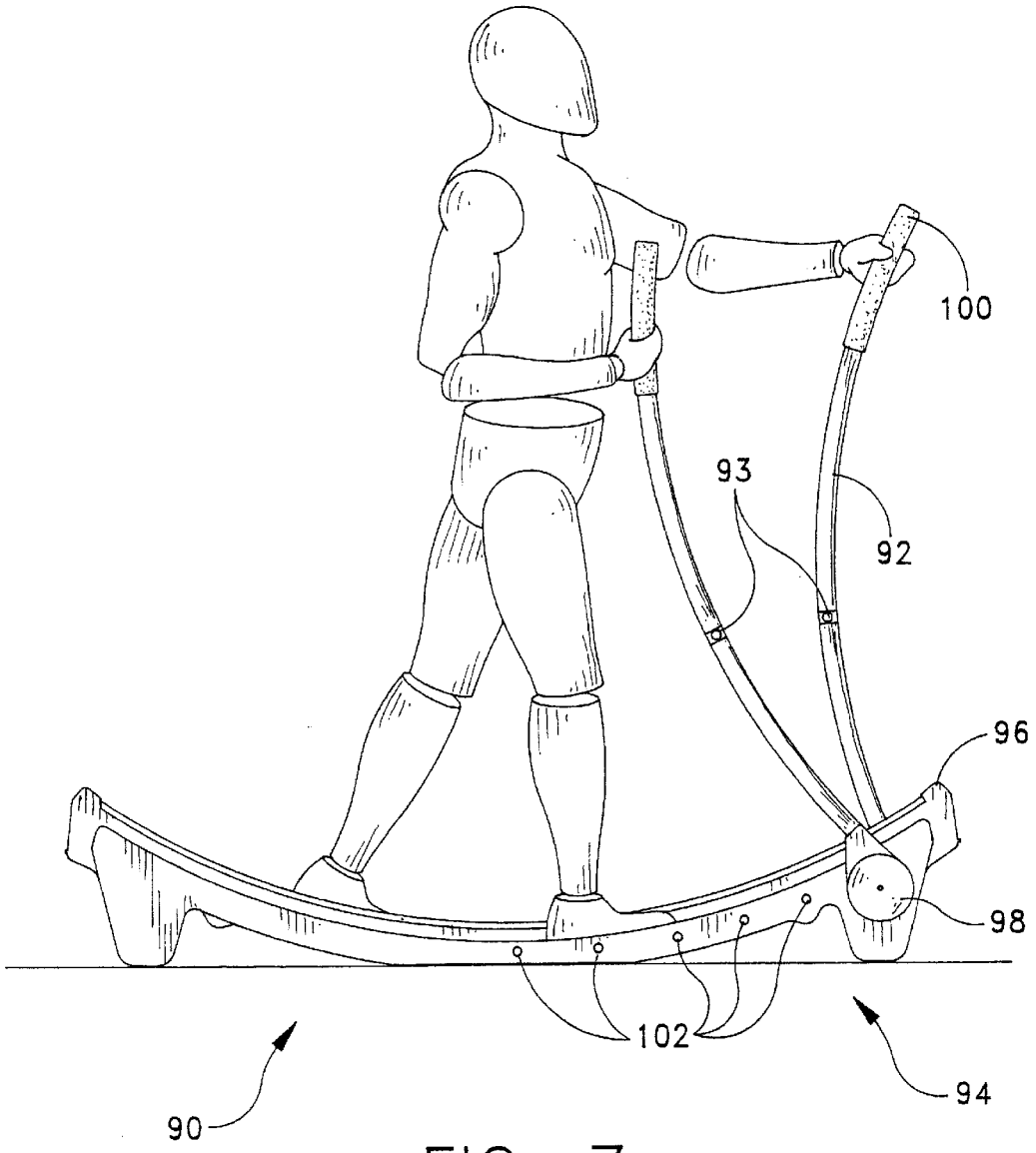
FIG. 7 is a side view of an alternate striding exerciser with pivotable hand levers to provide upper body resistance to the operator.

FIG. 7 illustrates an alternate embodiment of the striding exerciser 90 having curved, pivotable hand levers 92 attached to the front portion 94 of a base 96 by a variable resistance system 98. The operator achieves upper body exercise by gripping handle grips 100 on the pivotable hand levers 92 and reciprocating his arms back and forth in opposition to the variable resistance system 98. Preferably, the operator simultaneously reciprocates his feet and arms to achieve a total upper and lower body workout.

The pivotable hand levers 92 may be attached to the base 96 in a variety of locations. In the embodiment illustrated in FIG. 7, the base 96 has a series of attachment points 102 to which the variable resistance system 98 may be connected. It will be understood that the contour of the pivotable hand levers 92 illustrated in FIG. 7 may not be suitable for use with all attachment points 102, and that pivotable hand levers with different contours may be provided to the operator. Additionally, the pivotable hand levers 92 may be telescoping at a joint 93 so that they can be adjusted for the height of the operator and to facilitate shipping and storage.

The pole resistance system may be configured in a variety of ways known to those skilled in the art, such as the pole resistance system disclosed in U.S. Pat. No. 5,145,481, previously incorporated by reference. It will also be understood that the pivotable hand levers 92 may be connected to the base 96 of the striding exerciser 90 along a center line defined by the cover 44 (see FIG. 1). An exemplary embodiment of center mounted pivotable hand levers is disclosed in U.S. Pat. No. 5,145,481. It will be understood that the pivotable hand levers 92 may move independent of one another. Alternatively, a mechanical connection (not shown) may be provided for restricting movement of the pivotable hand levers 92 so that one hand lever moves forward while the other moves toward the rear at the same speed and through the same degree of travel.

Figure 8:
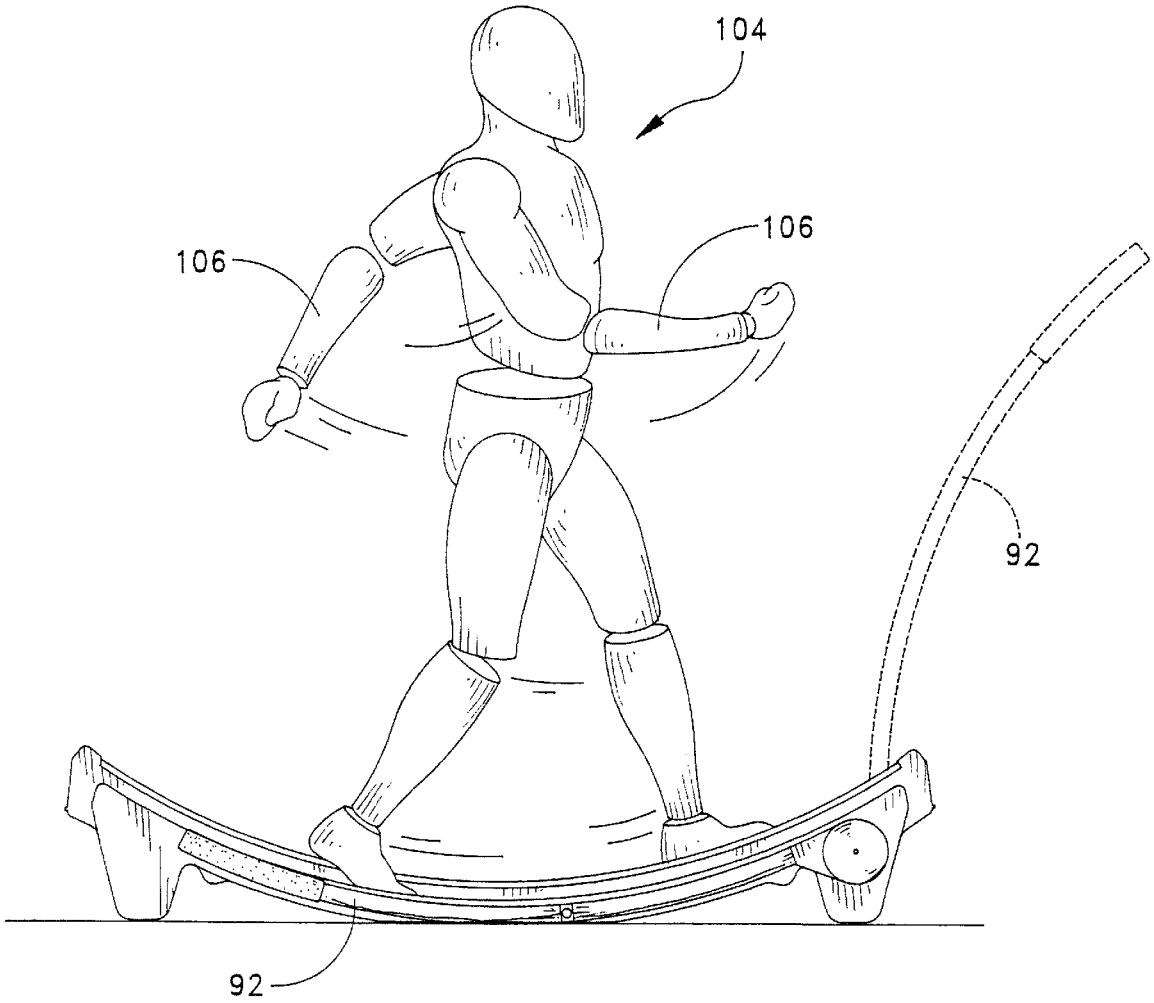
FIG. 8 is an alternative embodiment of the striding exerciser of FIG. 7 in which the pivotable hand levers are located outside the range of motion of the operator.

FIG. 8 is an alternate embodiment in which the pivotable hand levers 92 of FIG. 7 are moved to a forward and locked position out of the range of motion of the operator 104. In this embodiment, the operator 104 is permitted to move his arms 106 freely through the full range of motion without interference by the pivotable hand levers 92. The contour of the pivotable hand levers 92 generally corresponds to the contour of the base 96, so that they may be folded down parallel to the side of the base for storage and shipping, as illustrated in FIG. 8.

Figure 8B:
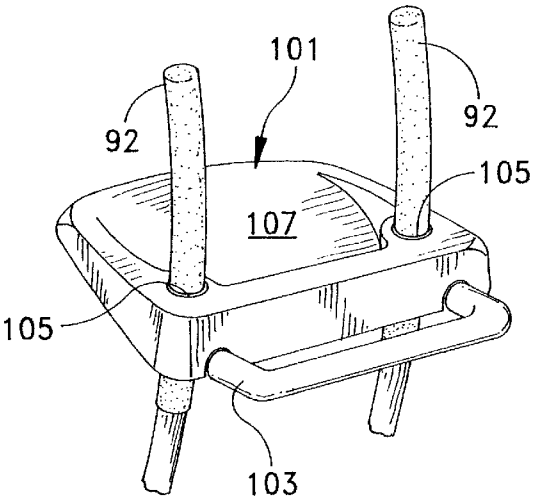
FIG. 8B is an exemplary bridge structure for joining the hand levers of FIG. 8A.
Figure 8A:
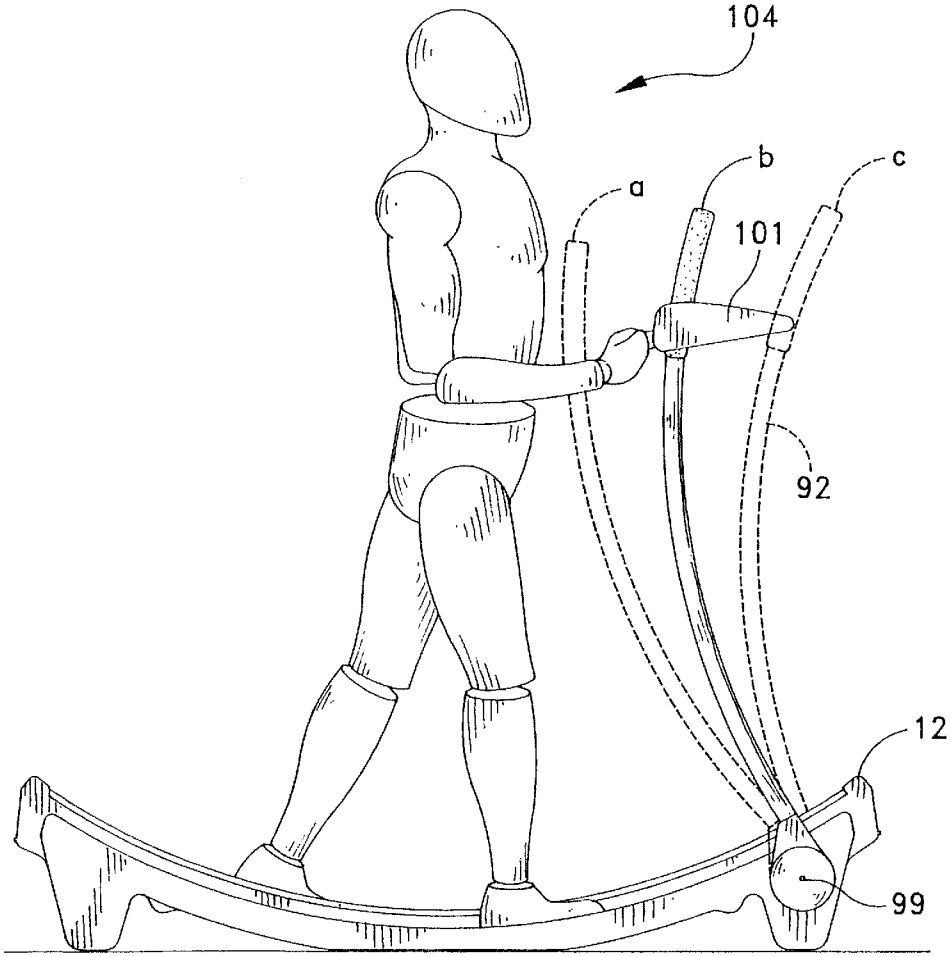
FIG. 8A is an alternative embodiment in which the pivotable hand levers are locked in a plurality of position within reach of the operator.

FIGS. 8A and 8B illustrate an alternate embodiment in which a locking mechanism 99 is provided to lock the pivotable hand levers 92 in a variety of positions a, b, c proximate the operator 104. A variety of structures are possible for locking the pivotable hand levers 92 in a fixed position, such as a spring loaded pin positioned to engage with a plurality of receiving holes on the base 12 (not shown). The spring may either bias the pin into or out of the receiving holes.

In the locked position, the pivotable hand levers 92 operate as handlebars, similar to those disclosed in FIG. 1. Providing a plurality of locking positions permits the operator 104 to select the optimum location for the pivotable hand levers 92 for his or her needs. A bridge 101 may be mounted to the pivotable hand levers 92 to provide additional stability to the structure. In the embodiment illustrate in FIGS. 8A and 8B, the bridge 101 has a pair of holes 105 into which the pivotable hand levers 92 may be inserted, however, it will be understood that a variety of mechanism may be utilized for attaching the bridge 101 to the levers 92. As illustrated in FIG. 8A, the bridge preferably has a handle 103 for gripping by the operator and a tray 107 for holding items, such as books or beverages. It will be understood that the present locking mechanism 99 and bridge 101 may be used with a variety of exercise equipment having movable hand levers for providing upper body resistance to the operator and that application is not limited to the present striding exerciser. For example, a number of ski machines and treadmill devices that provide hand levers may be modified to include the present locking mechanism and bridge, such as the device disclosed in U.S. Pat. No. 5,145,481, previously incorporated by reference.

Figure 9:
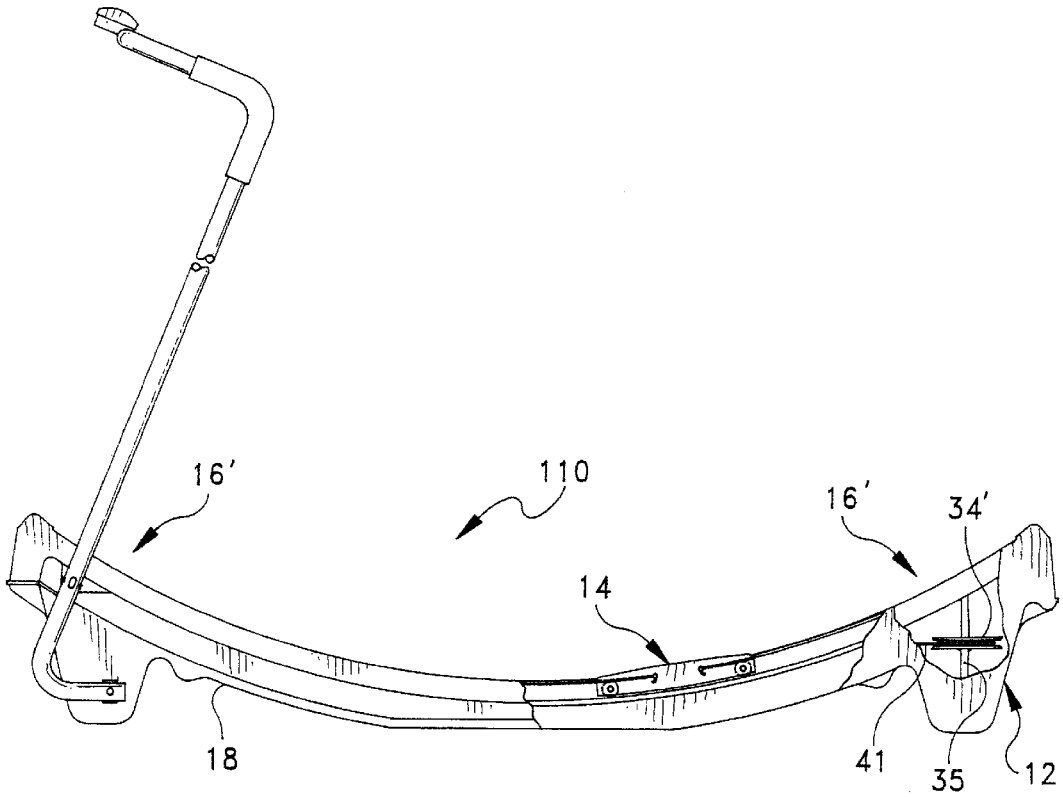
FIG. 9 is a sectional view of an alternate pulley system for interconnecting footskates on a striding exerciser.

FIG. 9 illustrates an alternate pulley configuration 16' located at the front and back of striding exerciser 110. Pulleys 34' are permitted to move freely or "float" up and down along shafts 35. The shafts 35 allow the pulleys 34' to remain aligned with the changing position of the cord 41 as the footskates 14 travel from the low center position to their maximum elevated position toward the ends of the striding exerciser 110. It will be understood that a spool with a larger hub region may be substituted for the pulleys 34'.

Figure 10:
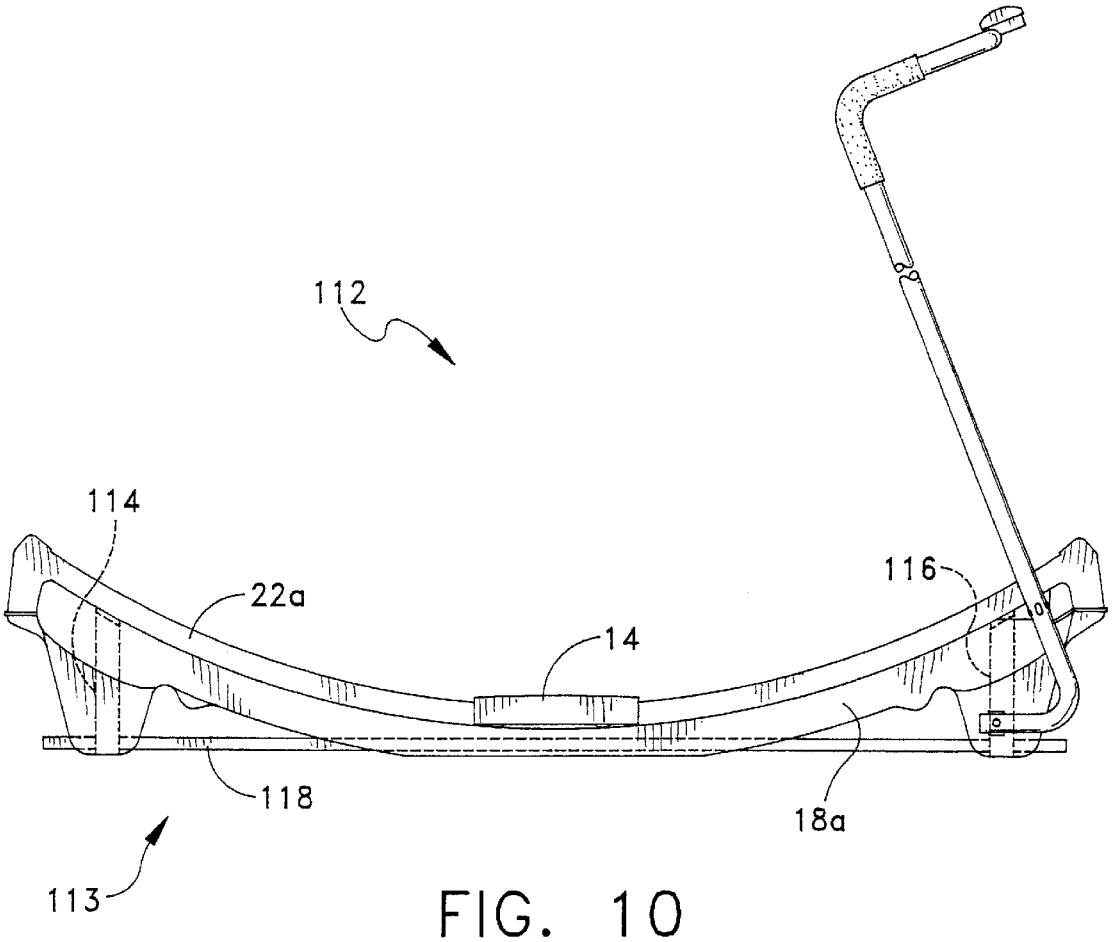
FIG. 10 is a sectional view of an exemplary adjustable track support system.

FIG. 10 is an alternate embodiment of the present striding exerciser 112 with an adjustable track support system 113. Elongated parallel tracks 22*a* are releasably attached to a contoured lower side 18*a*. A rear track support 114 and front track support 116 threadably mounted onto a threaded member 118 support the elongated parallel track 22*a*. The end portions of the threaded member 118 preferably have left- and right-handed threads, respectively, so that rotation of the threaded member 118 causes the front and rear track supports 116, 114 to simultaneously move toward or away from the middle portion 120 of the striding exerciser.

The elongated track 22*a* may be constructed from a variety of semi-rigid materials that are flexible enough to bend to the desired radius, yet resilient enough to support the reciprocating footskates 14 without substantial deflection. Suitable materials include laminated wood, fiberglass, Kevlar reinforced resin, resilient metals or combinations thereof.

Figure 11:
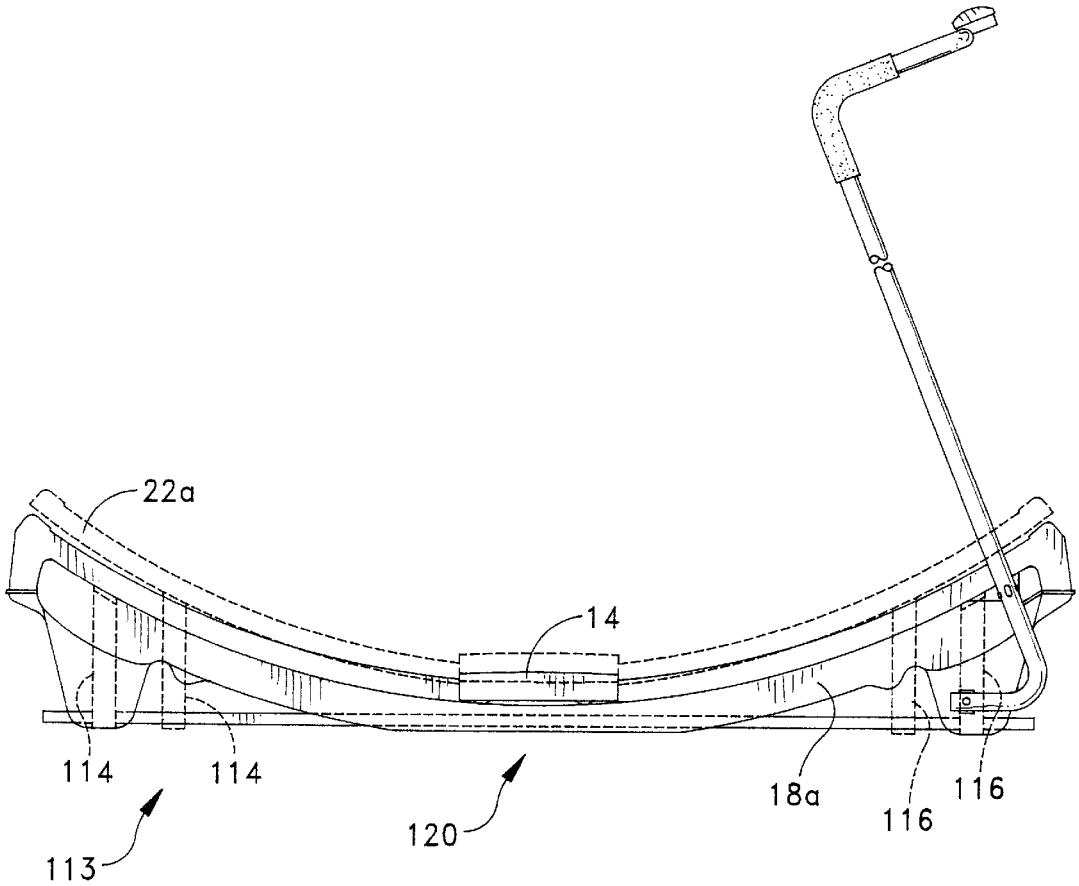
FIG. 11 is a sectional view of the exemplary adjustable track support system of FIG. 10 for modifying the radius of curvature of the elongated track.
Figure 11A:
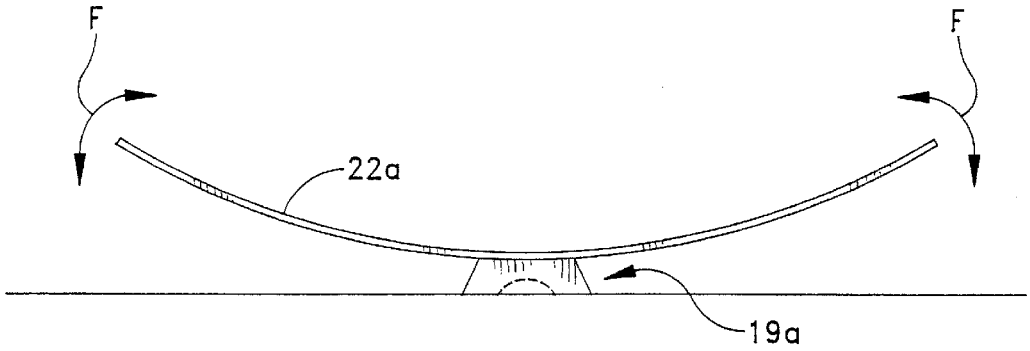
FIG. 11A schematically depicts another embodiment of the present invention.

FIG. 11 illustrates an alternate configuration of the adjustable track support system 113 of FIG. 10 in which the front and rear track supports 116, 114 have been moved toward the middle portion 120 of the striding exerciser 112 so that the radius of curvature of the elongated track 22*a* is decreased. The configuration of FIGS. 10 and 11 permits an operator to alter the radius of curvature of the elongated track 22*a* to match the swing arc of the operator. In an alternative embodiment, two separate threaded members may be provided so that the front and rear track supports 116, 114 may be adjusted independently. In yet another embodiment, the front and rear track supports 116, 114 may be manually moved and releasably attached to the contoured lower side 18*a* in order to adjust the radius of curvature of the elongated track 22*a*. In an alternate embodiment, the height of the front and rear track supports 116, 114 remain fixed and the middle portion 120 of the elongated tracks 22*a* is raised and lowered to achieve the desired radius of curvature. FIG. 11A schematically depicts another embodiment of the present invention wherein the elongated track 22*a* is supported on a flat supporting surface by a single support member, indicated at 19*a*, located generally centrally along the continuous arc of the track 22*a*. The support member 19*a* may be generally similar to the legs 19, modified to have a generally triangular or A-like shape. As represented by the arrows F, when the track 22*a* is constructed of a suitable semi-rigid, yet resilient material, this arrangement permits the ends of the track 22*a* to flex slightly and advantageously provides a flexible, impact-absorbing striding support for absorbing the impact imparted to the track 22*a* by a user, further relieving potential stress on the user's joints.

Figure 12:
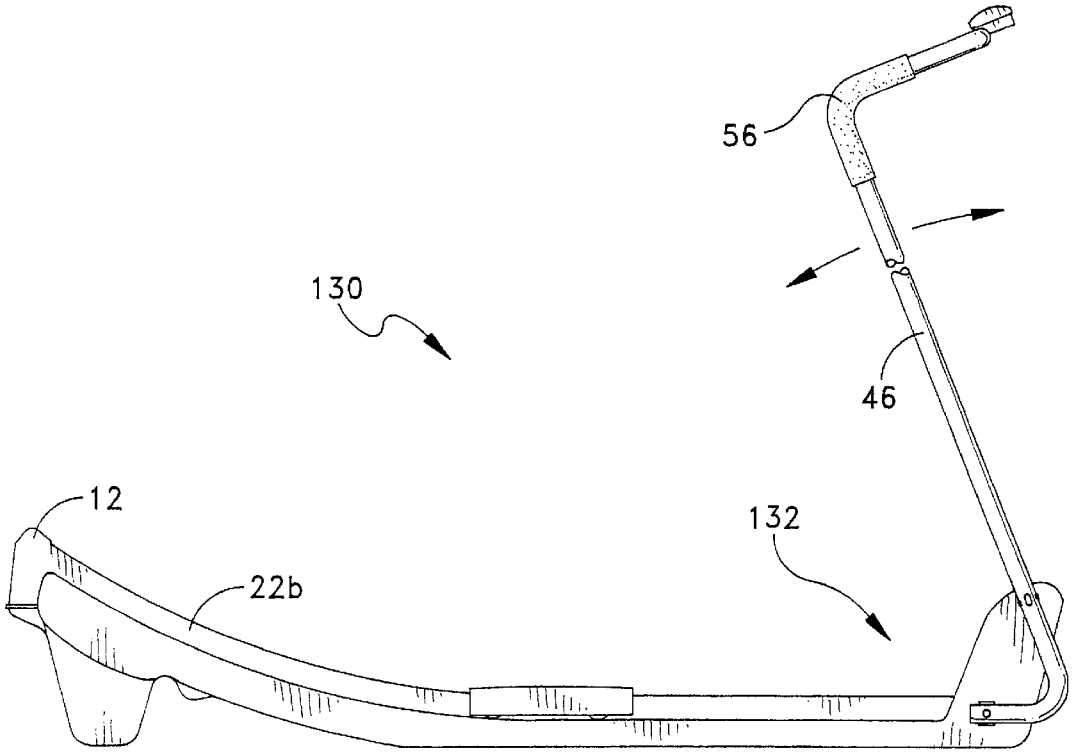
FIG. 12 is an alternate striding exerciser with a generally horizonal front portion.
Figure 13:
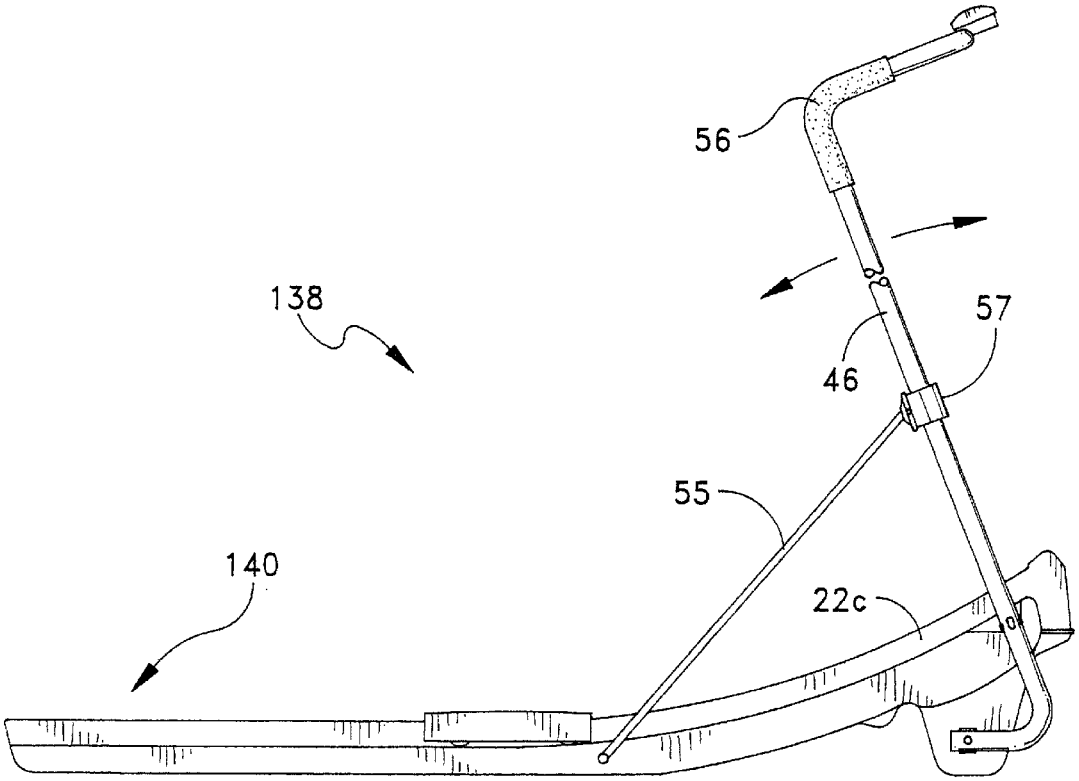
FIG. 13 is an alternate striding exerciser with a generally horizonal rear portion.

FIG. 12 is an alternate embodiment of a striding exerciser 130 having an elongated parallel track 22*b* generally horizontal along a front portion 132 thereof. The operator preferably grips handle grips 56 on the handlebars 46 to neutralize forward momentum due to the generally horizonal front portion 132. FIG. 13 is an alternate embodiment of a striding exerciser 138 in which the elongated parallel track 22*c* is generally horizontal along the rear portion 140 thereof. Again, handle grips 56 on the handlebars 46 may be gripped by the operator to counteract any rearward momentum due to the generally horizonal rear portion 140. An adjustable brace 55 with a sliding/locking clamp 57 may optionally be provided to reinforce the handlebars 46. In the embodiments in FIGS. 12 and 13, the handlebars 46 preferably are pivotally attached to the striding exercisers 130, 138 so that the position of the handle grips can be adjusted by the operator as illustrated by the arrow.

Figure 14:
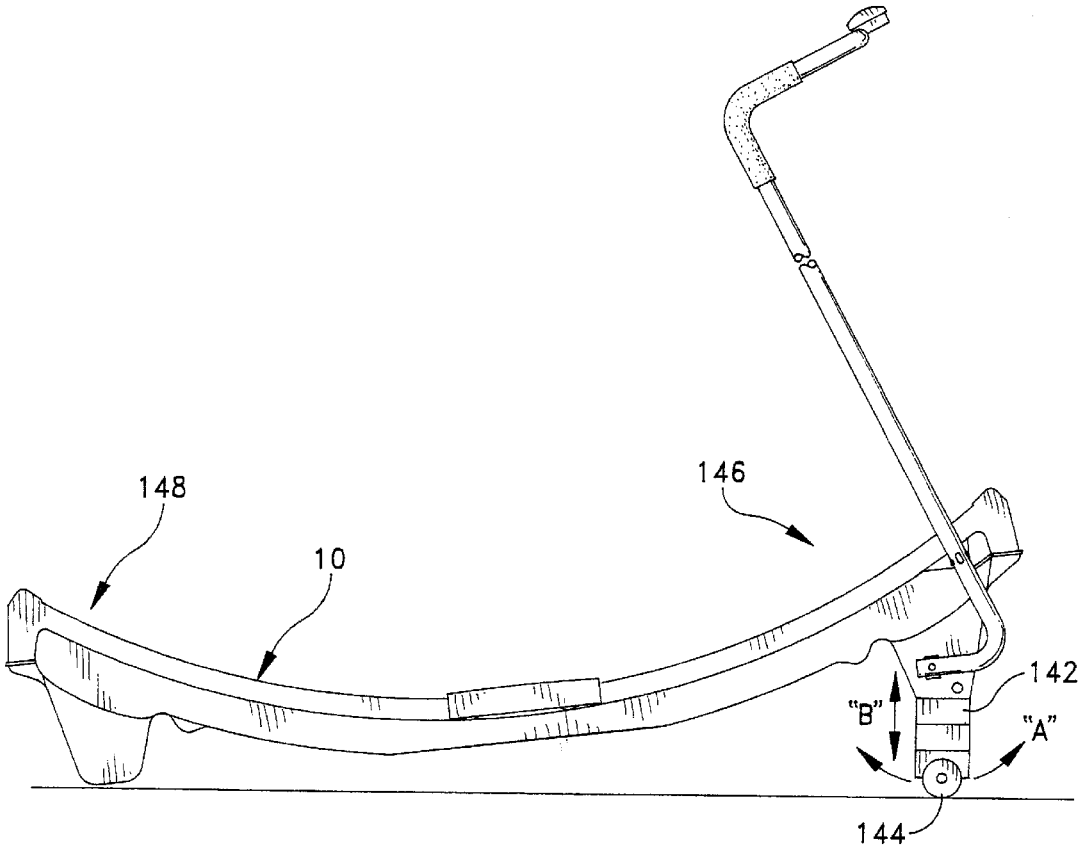
FIG. 14 is an alternate striding exerciser with an exemplary height adjustment mechanism.

FIG. 14 is an alternate embodiment of the striding exerciser 10 of FIGS. 1–5 in which a vertically adjustable support 142 is attached to the front portion 146. It will be understood that the vertically adjustable support 142 may pivot according to the arrow "A" or telescope according to the arrow "B". A roller 144 may be located under the telescoping support 142 to facilitate raising the front portion 146 and for moving the device. In the raised configuration illustrated in FIG. 14, the striding exerciser 10 simulates the embodiment illustrated in FIG. 13. In particular, the rear portion 148 is generally horizontal with respect to the steeper incline of the front portion 146. It will be understood that the telescoping support 142 may alternatively be located proximate the rear portion 148.

While there is shown and described herein certain specific structure embodying the invention, it will be manifest to those skilled in the art that various modification and rearrangements of the arts may be made without departing from the spirit and scope of the underlying inventive concept and that the same is not limited to the particular forms herein shown and described except insofar as indicated by the scope of the appended claims.

We claim:

1. A striding exercise device comprising:

a base having at least one elongated track defining a continuous arc that curves upwardly along at least one end portion thereof, at least a portion of said continuous arc having a curvature generally corresponding to a swing arc of an operator's leg;

two footskates slidably engaged with the at least one track, the footskates being operable for receiving feet of an operator thereon wherein the operator reciprocates the feet back and forth so that the footskates move in reciprocating motion along at least a portion of the continuous arc; and means for modifying the radius of curvature of the continuous arc.

2. The apparatus of claim 1 wherein the continuous arc has a front portion and a rear portion and the means for modifying the radius of curvature of the continuous arc comprises means for independently modifying the radius of curvature of the front and rear portions, respectively.

3. A striding exercise device comprising:

at least one elongated track defining a continuous arc that curves upwardly, at least a portion of said continuous arc having a curvature generally corresponding to a swing arc of an operator's leg;

a base including front and rear movable track supports for movably supporting said at least one track thereon, said at least one track being releasably retained on said front and rear track supports, said front and rear movable track supports being movable for changing the radius of curvature of the at least one track; and two footskates slidably engaged with the at least one track, the footskates being operable for receiving feet of an operator thereon wherein the operator reciprocates the feet back and forth so that the footskates move in reciprocating motion along at least a portion of the continuous arc.

* * * * *